US007725971B2

(12) United States Patent
Harmer

(10) Patent No.: US 7,725,971 B2
(45) Date of Patent: Jun. 1, 2010

(54) LIQUID CONTAINER CLEANER

(76) Inventor: Russell L. Harmer, 3569 Kings Hill Cir., Salt Lake City, UT (US) 84121

( * ) Notice: Subject to any disclaimer, the term of this patent is extended or adjusted under 35 U.S.C. 154(b) by 941 days.

(21) Appl. No.: 11/482,598

(22) Filed: Jul. 7, 2006

(65) Prior Publication Data

US 2008/0006297 A1 Jan. 10, 2008

(51) Int. Cl.
*E04H 4/16* (2006.01)

(52) U.S. Cl. ..... 15/1.7; 15/1; 68/29; 134/201; 119/264; 210/167.11; 210/198.1; 210/242.1; 422/265

(58) Field of Classification Search ..... 15/1, 15/1.7; 210/167.11, 198.1, 242.1; 422/264, 422/265; 446/153; 4/496; 441/1, 29; 134/201; 68/29, 30; 119/264
See application file for complete search history.

(56) References Cited

U.S. PATENT DOCUMENTS 2,249,559 A * 7/1941 Hilty ..... 15/247
2,304,127 A * 12/1942 Stetson ..... 15/231
4,429,429 A 2/1984 Altschul
4,604,766 A 8/1986 Avery
4,852,210 A * 8/1989 Krajicek ..... 15/228
5,722,871 A * 3/1998 Zamir ..... 446/153
6,161,246 A * 12/2000 Trachtenberg ..... 15/229.13
6,792,956 B2 9/2004 Bredo et al.
2006/0016034 A1 * 1/2006 Hillenbrand ..... 15/210.1
2006/0053572 A1 3/2006 Porat

OTHER PUBLICATIONS www.hydropool; Pool & Spa Supplies, Parts, & Accessories; taken from referenced cite Apr. 24, 2006.
www.intheswim.com; Great Way to Remove Stains and Scum Lines; taken from referenced cite Apr. 24, 2006.
www.poolandspa.com; Scumballs; taken from referenced cite Apr. 24, 2006.
http://online.thermospas.com; Scum Bug 2 Pk; taken from referenced cite Apr. 24, 2006.

* cited by examiner

*Primary Examiner*—Mark Spisich
(74) *Attorney, Agent, or Firm*—Thorpe North & Western LLP

(57) ABSTRACT

A cleaning device for cleaning sidewalls of a liquid container. The cleaning device includes a cover that can be removably disposed over a flotation device. The cover has a lower cleaning portion that cleans the sidewalls of the container upon contact with the sidewalls. The cover also has an upper non-cleaning portion.

10 Claims, 5 Drawing Sheets

LIQUID CONTAINER CLEANER

BACKGROUND

Many liquid containers, such as swimming pools, hot tubs, bathtubs, or the like, will experience a build up of unwanted chemicals, dirt, oils and other contaminants around the perimeter wall of the container at the level of the liquid-air interface. This build up around the perimeter is often referred to as a ring and is increased by variations in the liquid level that allow residual liquid along the container perimeter to dry, thereby leaving a chemical, mineral or other deposits on the container wall. As the inner wall is exposed to the liquid in the container, the deposits build upon previous deposits until a discolored and unsightly ring often forms around the container perimeter wall.

Cleaning devices have been developed to clean the deposits from the walls of pools, tubs, and other containers. Most of these cleaning devices involve automated machines that spray a cleaning solution onto the container surface and then scour the surface with a brush. Unfortunately, these types of devices usually involve continual monitoring during the cleaning process and may involve considerable set up and take down time.

Other types of cleaners involve free floating devices that can move about the container and spray jets along the container walls. Unfortunately, these devices require motors to move the cleaner and a mechanism to ensure that the jests are sprayed on the walls. Additionally, these devices are turned on and off in order to activate the device for cleaning or deactivate the device to conserve the power supply.

SUMMARY

An embodiment of the present invention provides a cleaning device for cleaning sidewalls of a liquid container. The cleaning device can include a cover that can be removably disposed over a flotation device. The cover can have a lower cleaning portion that can clean the sidewalls of the container upon contact with the sidewalls. The cover can also have an upper noncleaning portion.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION OF EXEMPLARY EMBODIMENT(S)

Figure 1:
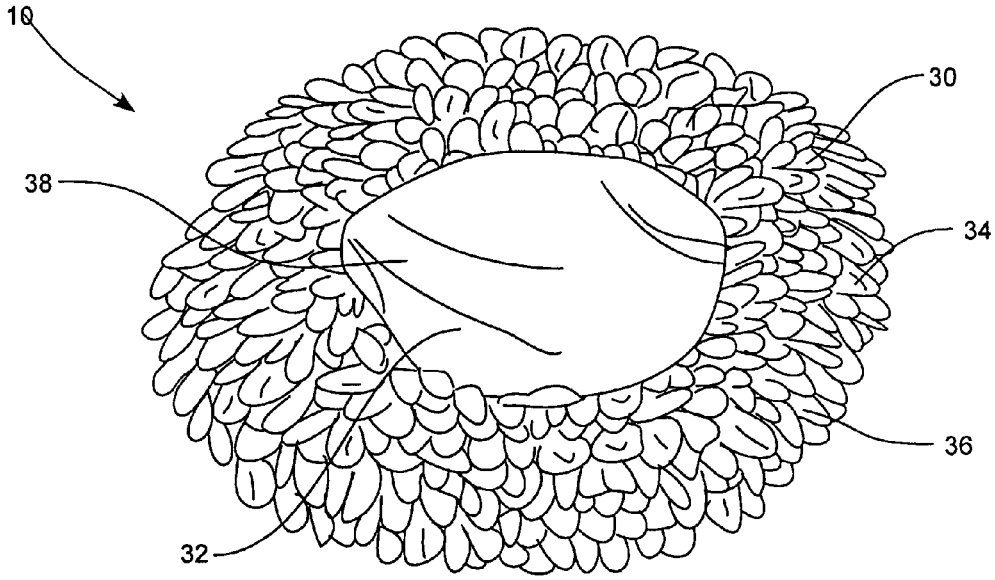
FIG. 1 is a perspective top view of a cleaning device for cleaning sidewalls of a liquid container in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. The following detailed description and exemplary embodiments of the invention will be best understood by reference to the accompanying drawings, wherein the elements and features of the invention are designated by numerals throughout.

The present invention includes a cleaning device that can cover a flotation device and can be placed within a liquid container such as a swimming pool, hot tub, or the like. The covered flotation device can float freely around the liquid container and contact the perimeter sidewall of the container thereby cleaning the perimeter sidewall of the liquid container. The flotation device can include a soft abrasive or cleaning material around a lower portion of the device. The soft abrasive material can extend above and/or below the liquid level in the container. An upper portion of the device can include a noncleaning material. The noncleaning material can be a less absorbent and lighter weight material than the lower portion. The flotation device may be at least partially submerged in the liquid in the container so that the lower cleaning portion of the cleaning device can contact the sidewall at a desired level within the liquid.

For example, in use, the cleaning device can be placed over a float and set into a pool. The float covered by the cleaning device can be partially submerged so that the lower cleaning portion of the cleaning device can clean a portion of the pool sidewall that is below the level of water in the pool and also a portion of the pool sidewall that is above the level of water in the pool. In this way the cleaning device of the present invention can clean the sidewall of the pool at the liquid-air interface where chemicals from the water are likely to be deposited or condensate out from the liquid.

Figure 2:
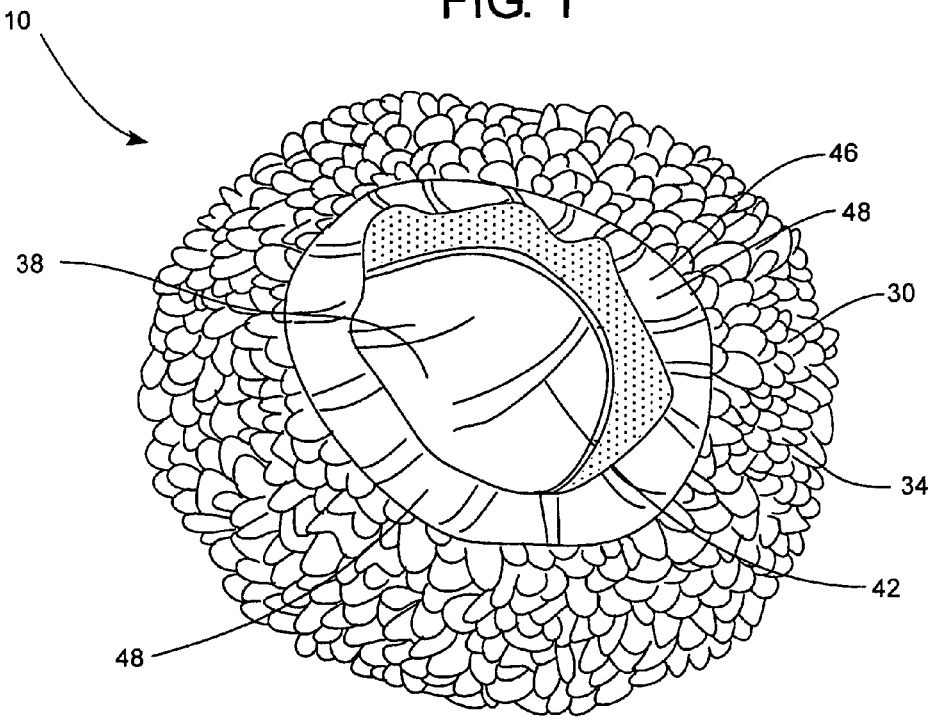
FIG. 2 is a perspective bottom view of the cleaning device of FIG. 1.
Figure 3:
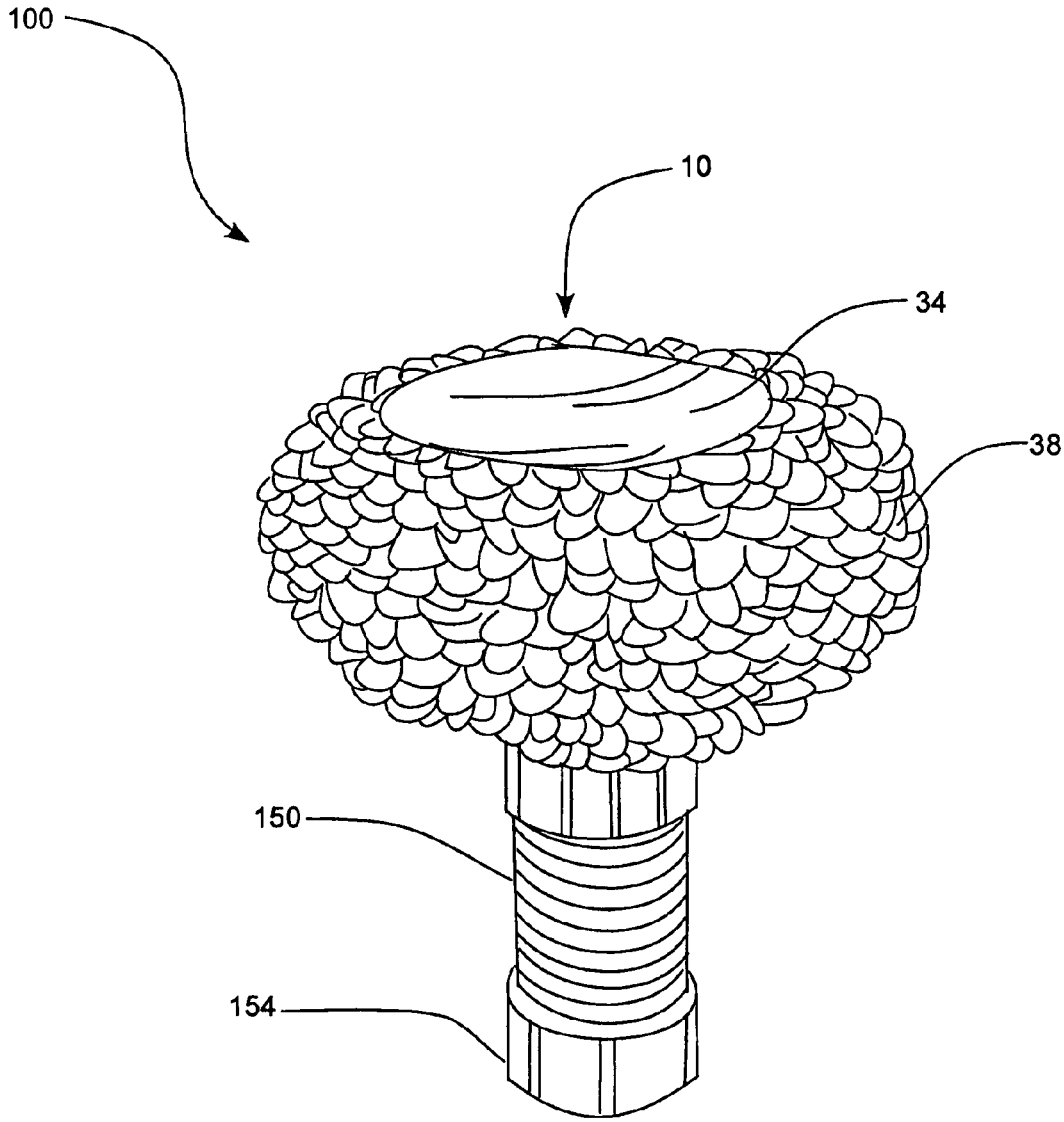
FIG. 3 is a perspective view of a flotation device for cleaning sidewalls of a liquid container in accordance with another embodiment of the present invention.

As illustrated in FIGS. 1-2, a cleaning device, indicated generally at 10, in accordance with the present invention is shown for use in cleaning the perimeter sidewalls of a liquid container, such as a swimming pool, hot tub, bath tub, yard pond, fish tank or the like. The cleaning device can include a cover 30 that can be removably disposed over a flotation device, or float 150 (FIG. 3). The cover 30 can include a lower cleaning portion 34 that can clean the perimeter sidewalls of the container upon contact with the sidewalls and an upper noncleaning portion 38

The lower cleaning portion 34 can be sized and shaped to fit over a float 150 that can float at a desired level in the liquid in the liquid container. The cleaning portion 34 can include a cleaning material 36 that can remove and clean grime deposits from the container sidewalls and retain the deposit material in or on the absorbent fabric. The cleaning material 36 can be absorbent and can retain liquid absorbed from the liquid container to weight and at least partially submerge the flotation device. The cleaning material 36 can include: a polyester fabric, cotton fabric, sponge, microfiber fabric, terry cloth, chenille fabric, wool, Polyester and Polyamide microfiber fabric, and combinations of these materials.

FIG. 2 illustrates that the lower cleaning portion 34 can also include an opening 42 that can be sized and shaped to fit over the float 150. The opening 42 can include a sizing element 46 that can increase the size of the opening during installation of the cover 30 on the flotation device. After installation of the cover 30 on the flotation device, the sizing element 46 can reduce the size of the opening 42 in order to restrict removal of the cover 30 from off the flotation device. For example, the sizing element 46 can be an elastic band 48, as shown in FIG. 2, that can be stretched to allow the cover to fit over the flotation device. As another example, the sizing element 46 can be a drawstring (not shown) that can be gather the material 36 of the lower cleaning portion 34 around the opening 42 in order to size the opening 42 to a sufficient size to fit over the flotation device during installation.

The upper noncleaning portion 38 can be a different material from the lower cleaning portion 34. For example, the upper noncleaning portion 38 may include a less absorbent (or even absorbent resistant) material 32 that can be lighter in weight so as to reduce sinking of the float 150. In this way, the float can be weighted in order to float at a desired level within the liquid contained in the liquid container. Additionally, the upper noncleaning portion 38 can be a material 32 that is visually distinguishable from the surface of the liquid so as to make the cleaning device 10 easily visible. Thus, the upper noncleaning portion 38 can include a polyester fabric, cotton fabric, wool fabric, microfiber material, plastic material, netting, mesh, and combinations of these materials.

The cleaning device 10 can also include an oil absorbent material 32. The oil absorbent material can absorb oils introduced into the liquid container that may float or be suspended within the liquid. The oil absorbent material 32 can include a sponge like material that can absorb body oils, suntan lotion, makeup, soap, dead skin, or the like.

As illustrated in FIG. 3, a flotation device, indicated generally at 100, in accordance with another embodiment of the present invention is shown for use cleaning the perimeter sidewalls of a liquid container, such as a swimming pool, hot tub, bath tub, yard pond, fish tank or the like. The flotation device 100 can include a float 150 and a cover 10 described above and shown in FIGS. 1-2.

The float 150 can be a device commonly used as a flotation device in the liquid container. For example, the float 150 can be a floating chlorinator, as commonly used in swimming pools and hot tubs or spas. As another example, the float 150 can be an inflatable device such as a ball or other such toy that is commonly used in a swimming pool.

Advantageously, the cleaning device 10 of the present invention can be cleaned and repeated reused. For example, the cleaning device 10 can be placed in a liquid container and allowed to clean the container for a predetermined period of time, such as approximately 30 days, or until the cleaning device appears dirty. The cleaning device 10 can them be removed from the liquid container and can be cleaned or washed, such as in a clothes washing machine. The cleaning device 10 can them be replaced into the liquid container to clean the sidewalls of the container. In this way, the cleaning device 10 can be repeatedly reused, thereby eliminating the need to purchase new cleaning devices.

Figure 4:
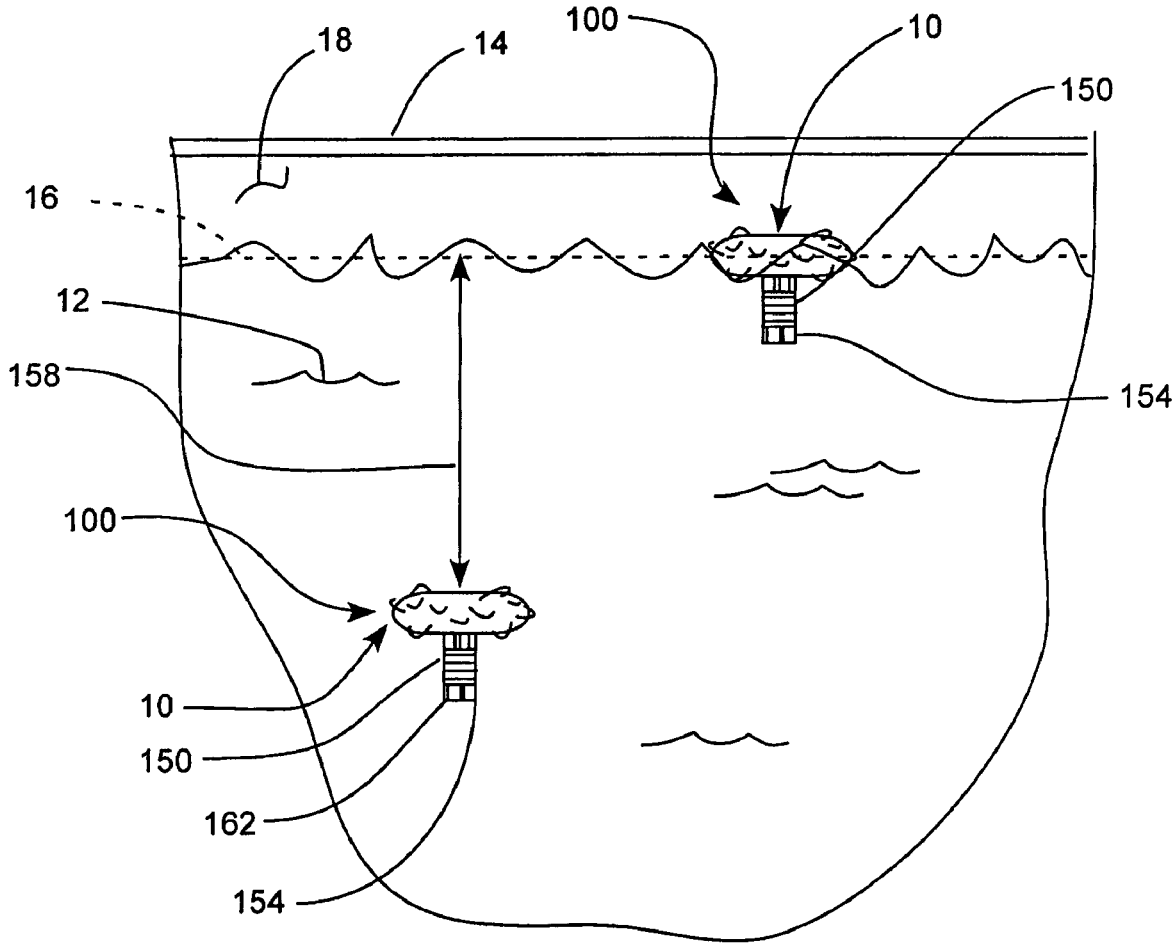
FIG. 4 is a cut-away side view of the flotation device of FIG. 3 floating in a liquid container.

Referring to FIGS. 3-4, the float 150 can also be at least partially submergible with respect to a liquid level in the container. The float 150 may include a weight 154 that can ballast the float in order to submerge the float to a desired level within the liquid 12 contained in the container 14. In this way, the float 150 can be partially submerged at the level of the liquid 16 in the container 14 so as to allow cleaning of the sidewalls 18 of the container at the approximate level of liquid in the container. Additionally, the weight 154 can be sufficient to wholly submerge the float 150 to a predetermined depth 158 so as to allow cleaning of the sidewalls 18 of the container below the approximate level of liquid 16 in the container.

The float 150 can also include variable ballast 162 that can be adjusted to at least submerge the float to a predetermined level in the liquid. Additionally, the ballast 162 can include a dissolvable cleaning agent, as known in the art, that can dissolve upon contact with the liquid over a predetermined period of time so that the predetermined submerged level of the float 150 can decrease as the dissolvable cleaning agent dissolves and reduces the weight of the ballast 162. Accordingly, the float 150 can include at least one cleaning agent dispersion port 166 (FIG. 5*a*) that can disperse the cleaning agent into the lower cleaning portion 34 or sides of the cover 10. In this way the float 150 can allow cleaning of the entire sidewall 18 of the liquid container 14 below and at the approximate level of liquid 16 in the container.

The float 150 can float freely in the liquid 12 in the liquid container 14. The float can move about the liquid container 14 in response to movement of the liquid in the container. In this way the float 150 can move the cleaning cover 10 about the liquid 12 container 14 in a random pattern and can contact and abrade at least a majority of the perimeter of the sidewalls 18 in response to various movements of the liquid in the container. Thus, it is a particular advantage of the cleaning device of the present invention that the cleaning cover can clean the sidewalls without motors or a power source that might need maintenance and replacement.

Returning to FIG. 3, the flotation device 100 can also include a cover 10 as described above and shown in FIGS. 1-2. The cover 10 can be removably disposed over the float 150 and can have a lower cleaning portion 38 that can clean the sidewalls of the container upon contact with the sidewalls. The cover can also have an upper noncleaning portion 34, and a sizable opening 42 (FIG. 3) to allow placement of the cover 10 over the float 150.

Figure 5A:
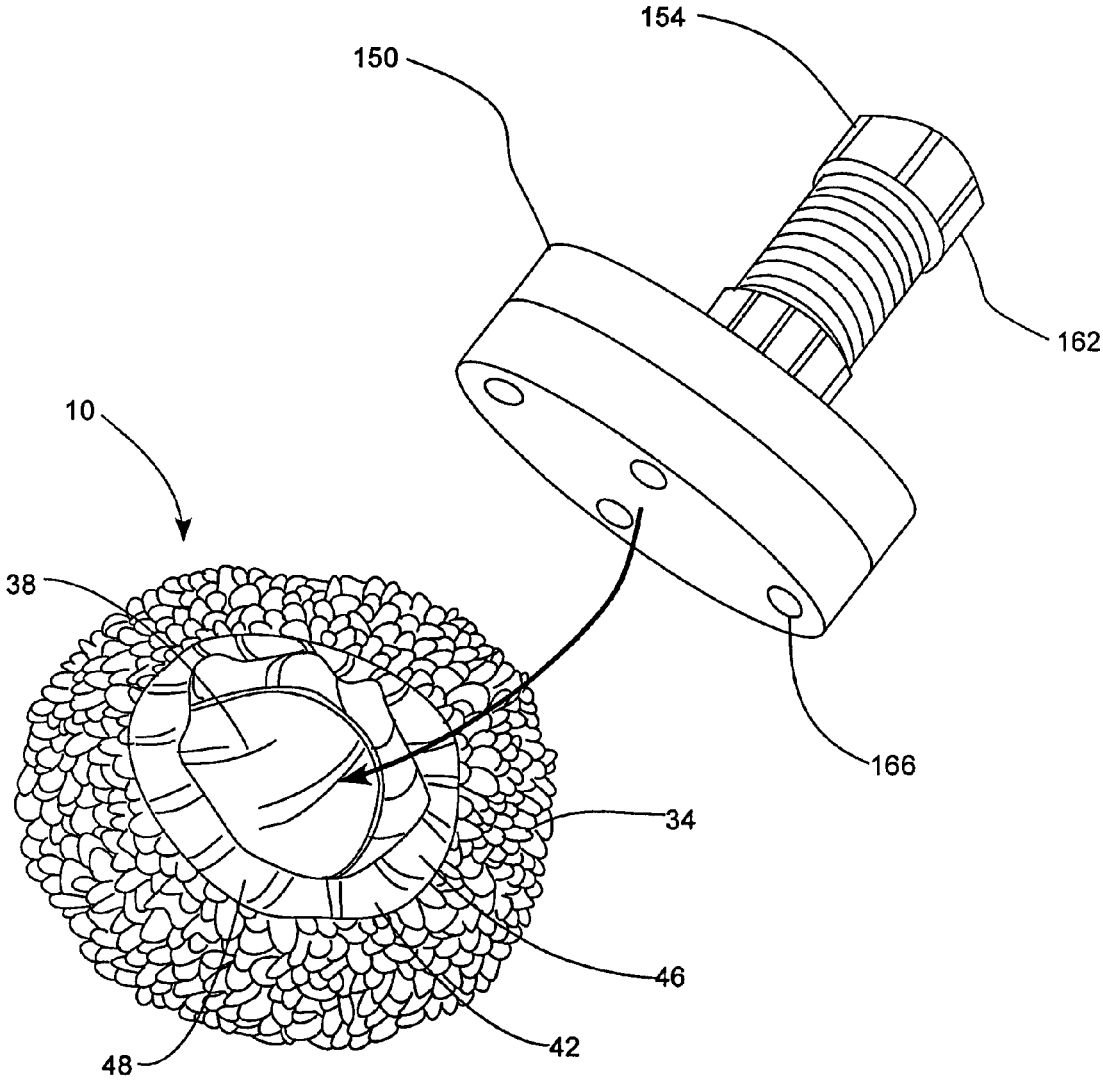
FIGS. 5*a*-5*b* illustrate a method for cleaning the sidewalls of a liquid cleaning device in accordance with an embodiment of the present invention.
Figure 5B:
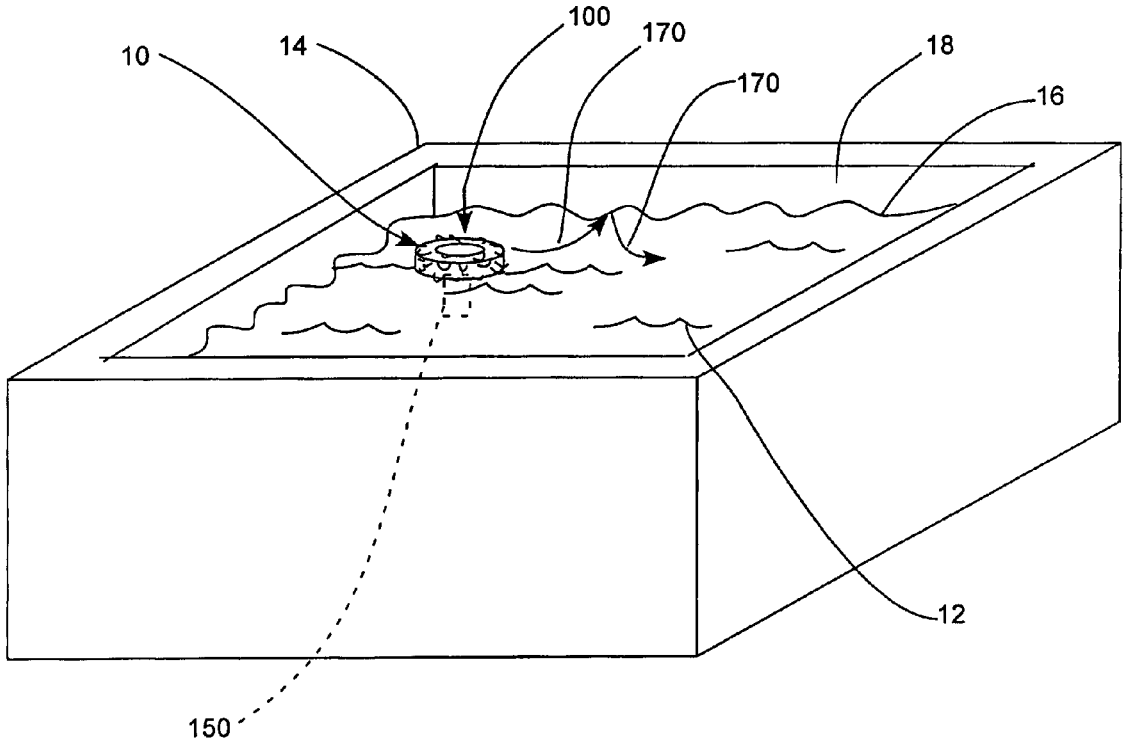

As illustrated in FIGS. 5*a*-5*b*, the present invention also includes a method for cleaning a liquid container sidewall including placing a cover 10 over a float 150 to form a sidewall cleaning device 100. The cover 10 can have a lower cleaning portion 34 that can clean the sidewalls 18 of the container 14 upon contact with the sidewalls. The cover 10 can also have an upper noncleaning portion 38. The cleaning device 100 can be floated in liquid 16 contained in the liquid container 14. The cleaning device 100 can float freely in the liquid 16 and can contact the sidewalls 18 of the container 14 in response to movement of the liquid in the container as shown by arrows 170. The cleaning device can contact the sidewalls such that the lower cleaning portion 34 can abrade and clean the sidewalls 18 to remove grime deposits, such as chemical and mineral deposits.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A flotation device configured to clean sidewalls of a liquid container, comprising:

a float at least partially submergible with respect to a liquid level in the container, configured to contact the sidewalls of the container in response to liquid movement, and including a variable ballast to at least partially submerge the float to a predetermined level in the liquid, wherein the ballast weight includes a dissolvable cleaning agent configured to dissolve upon contact with the liquid over a predetermined period of time such that the predetermined submerged level of the float decreases as the dissolvable cleaning agent dissolves;

a cover, removably disposed over the float, having a lower cleaning portion configured to clean the sidewalls of the container upon contact with the sidewalls and an upper noncleaning portion coupled to the lower cleaning portion.

2. The device of claim 1, wherein the float includes a weight.

3. The device of claim 1, wherein the float includes at least one cleaning agent dispersion port configured to disperse a cleaning agent into the lower cleaning portion of the cover.

4. The device of claim 1, wherein the upper noncleaning portion has an opening sized and shaped to fit over the float.

5. The device of claim 4, wherein the opening includes an elastic band configured to stretch the opening to a size sufficient to fit over the float and to restrict removal of the cover from off the float.

6. The device of claim 4 wherein the opening includes a drawstring configured to increase the opening to a size sufficient to fit over the float and to be drawn to a size that restricts removal of the cover from off the float.

7. The device of claim 1, wherein the noncleaning portion includes an absorbent resistant material.

8. The device of claim 1, wherein the noncleaning portion includes a material that is visually distinguishable from the surface of the liquid.

9. The device of claim 1, wherein the lower cleaning portion includes a cleaning material configured to remove and clean deposits from the container sidewalls and retain the deposit material in an absorbent fabric.

10. The device of claim 1, wherein the liquid container is selected from the group consisting of a swimming pool, a hot tub, a bathtub, a yard pond, and a fish tank.

* * * * *